US008913778B2

(12) United States Patent
Mitsuhashi

(10) Patent No.: US 8,913,778 B2
(45) Date of Patent: Dec. 16, 2014

(54) STRUCTURE FOR PREVENTING A FALL OF A SPEAKER DEVICE FROM A MAIN APPLIANCE

(75) Inventor: Renichi Mitsuhashi, Tokyo (JP)

(73) Assignee: NEC Display Solutions, Ltd., Tokyo (JP)

( * ) Notice: Subject to any disclaimer, the term of this patent is extended or adjusted under 35 U.S.C. 154(b) by 0 days.

(21) Appl. No.: 13/876,459

(22) PCT Filed: Sep. 30, 2010

(86) PCT No.: PCT/JP2010/067042

§ 371 (c)(1),
(2), (4) Date: Mar. 27, 2013

(87) PCT Pub. No.: WO2012/042630

PCT Pub. Date: Apr. 5, 2012

(65) Prior Publication Data

US 2013/0182884 A1 Jul. 18, 2013

(51) Int. Cl.
*H04R 1/02* (2006.01)

(52) U.S. Cl.
CPC ..... *H04R 1/026* (2013.01); *H04R 2499/15* (2013.01); *H04R 1/028* (2013.01)
USPC ..... 381/395; 381/87

(58) Field of Classification Search
CPC ..... H04R 1/026; H04R 2201/02; H04R 2201/021
USPC ..... 381/87, 332–336, 386, 388, 395
See application file for complete search history.

(56) References Cited

U.S. PATENT DOCUMENTS

| | | | | |
|---|---|---|---|---|
| 2003/0059077 | A1 | 3/2003 | Kambe | |
| 2005/0157889 | A1 * | 7/2005 | Yonezu | 381/77 |
| 2009/0190787 | A1 * | 7/2009 | Pieklik et al. | 381/386 |

FOREIGN PATENT DOCUMENTS

| | | | |
|---|---|---|---|
| JP | 50-055830 | | 5/1975 |
| JP | 61-166680 | | 10/1986 |
| JP | 64-011089 | | 1/1989 |
| JP | 05-183976 | A | 7/1993 |
| JP | 05-321880 | A | 12/1993 |
| JP | 2000-244992 | A | 9/2000 |
| JP | 2003-078979 | A | 3/2003 |
| JP | 2003-102081 | A | 4/2003 |
| JP | 2005-286960 | A | 10/2005 |
| JP | 2008-128026 | A | 6/2008 |
| JP | 2009-005263 | A | 1/2009 |

OTHER PUBLICATIONS

Machine Translation of Japanese Publication No. 2000-244992, Onishi et al., 2000.*

(Continued)

*Primary Examiner* — Ahmad Matar
*Assistant Examiner* — Katherine Faley
(74) *Attorney, Agent, or Firm* — McGinn IP Law Group, PLLC

(57) ABSTRACT

Provided is a speaker fall prevention structure, which includes a speaker device formed by housing a speaker unit in a housing independent of a main appliance, a speaker attaching part provided to the main appliance to allow the speaker device to be attached, an attached part facing the speaker attaching part in the speaker device, a fall prevention wire set between the speaker device and the main appliance, and a fastening member for attaching the attached part to the speaker attaching part. Using the fastening member, a first end of the fall prevention wire is fastened and fixed to the main appliance along with the attached part.

17 Claims, 6 Drawing Sheets

(56) References Cited

OTHER PUBLICATIONS

Machine Translation of Japanese Publication No. 2003-078979, Onishi et al., 2003.*

International Search Report in PCT/JP2010/067042 dated Nov. 2, 2010 (English Translation Thereof).

* cited by examiner

STRUCTURE FOR PREVENTING A FALL OF A SPEAKER DEVICE FROM A MAIN APPLIANCE

TECHNICAL FIELD

The present invention relates to a speaker fall prevention structure that is attached to a main appliance independently of the main appliance.

BACKGROUND ART

Conventionally, there is an optional speaker that has a housing independent of a main appliance such as a monitor and that is attached to the main appliance. The optional speaker is attached to a lateral portion of the main appliance using fixing means such as screws (e.g., see Patent Document 1).

Incidentally, due to an excessive external force to the speaker device or degradation caused by long-term use of the speaker device, there is a risk of an attached part facing the main appliance becoming broken in the housing of the speaker device. In particular, when the main appliance is installed at a high position, repair of such damage becomes an issue.

On the other hand, there is a speaker which is installed on a wall of a house and to which a fall preventing wire is provided (e.g., see Patent Document 2). This provides a structure in which a signal wire rod and the fall preventing wire are used as a speaker cord in a bundle, and in which a fixing part, in which the wire is fixed to the wall of the house, is configured so that the signal wire rod is in a conducted state in accordance with the fixing work. Thereby, in comparison with a case in which the signal wire rod and the fall preventing wire are separately provided, the layout of the speaker cord can be simplified, and the fall preventing wire can be reliably operated by accompanying the fixture of the fixing part with the conduction of the signal wire rod.

PRIOR ART DOCUMENTS

Patent Documents

Patent Document 1: Japanese Unexamined Patent Application Publication No. 2005-286960

Patent Document 2: Japanese Unexamined Patent Application Publication No. 2009-005263

DISCLOSURE OF THE INVENTION

Problems to be Solved by the Invention

Incidentally, even when the speaker device is attached to the main appliance as described above, a configuration capable of effectively preventing the falling of the speaker device and suppressing an increase in man-hours and a complication of structure accompanied with the setting of the fall preventing wire is required.

Thus, the present invention is directed to provide a speaker fall prevention structure capable of preventing a fall of a speaker attached to a main appliance and suppressing an increase in man-hours and a complication of structure caused by setting of a fall preventing wire.

Means for Solving the Problems

To solve the above problems, the present invention provides the following means.

(1) That is, a speaker fall prevention structure of the present invention is a structure for preventing a fall of a speaker device formed by housing a speaker unit in a housing independent of a main appliance, and includes a speaker attaching part provided to the main appliance to allow the speaker device to be attached, an attached part facing the speaker attaching part in the speaker device, a fall preventing wire set between the speaker device and the main appliance, and a fastening member for attaching the attached part to the speaker attaching part. Using the fastening member, a first end of the fall preventing wire is fastened and fixed to the main appliance along with the attached part.

(2) The speaker fall prevention structure set forth in the foregoing (1) is configured so that a wire attaching part of the speaker device to which a second end of the fall preventing wire is attached is formed on a vertical middle portion of the speaker device.

(3) The speaker fall prevention structure set forth in the foregoing (1) or (2) is configured so that the housing of the speaker device is dividedly made up of a first housing forming a sound outputting part and a second housing connected to a rear of the first housing, so that at least one of the first and second housings is formed of a plastic molding, and so that the attached part is integrally formed with the housing.

(4) The speaker fall prevention structure set forth in any one of the foregoing (1) to (3) is configured so that the fall preventing wire is configured so that the first end thereof which is fastened and fixed to the main appliance extends to follow an outer surface of the housing of the speaker device, and the second end thereof is fixed to the speaker unit of the speaker device.

Effects of the Invention

According to the present invention, even when the attached part of the speaker device is damaged, the fall of the speaker device can be effectively prevented. An increase in man-hours and structural complication caused by setting the fall preventing wire can be suppressed.

EMBODIMENTS FOR CARRYING OUT THE INVENTION

Figure 1:
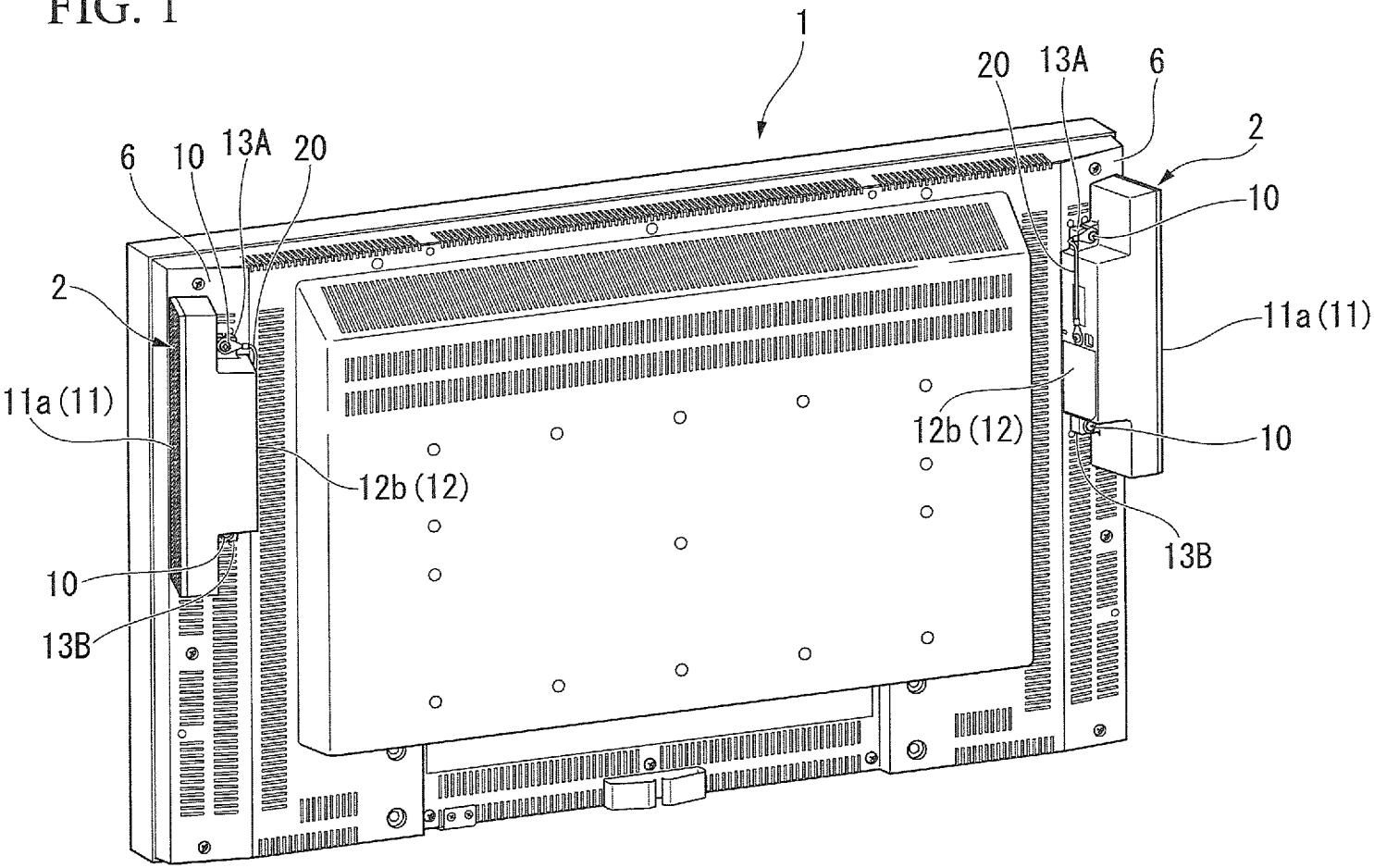
FIG. 1 is a perspective view showing an embodiment of a speaker fall prevention structure of the present invention.

FIG. 1 shows an example in which left and right speaker devices 2 are attached as optional speakers to respective rear sides of left and right lateral portions of a monitor (main appliance, e.g. thin screen television) 1 as an embodiment of the present invention. The left and right speaker devices 2 are attached to the respective left and right lateral portions of the monitor 1 by a pair of upper and lower screws 10.

Hereinafter, the speaker device 2 of the right side of FIG. 1 will be described as an example. However, the speaker device 2 of the left side of FIG. 1 also has a similar configuration.

Figure 7:
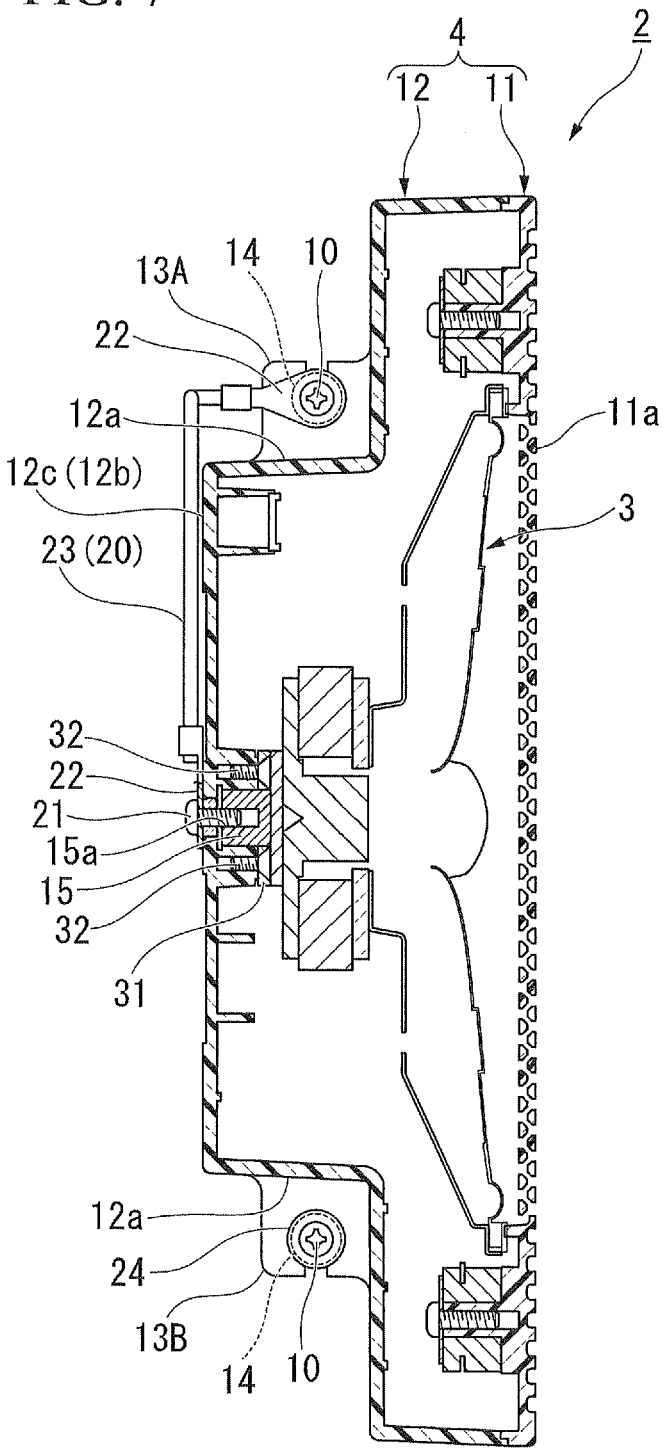
FIG. 7 is a cross-sectional view taken along line A-A of FIG. 6.

As shown in FIG. 7, the speaker device 2 includes a speaker unit 3 having a vibration part and a magnetic circuit part in one body, and a housing 4 housing the speaker unit 3. The housing 4 is dividedly made up of a first housing 11 that is shaped of a box long in a vertical direction (see FIG. 2) and that forms a latticed or porous sound outputting part 11 *a*, and a second housing 12 connected to the rear of the first housing 11. The housings 11 and 12 are plastic moldings independent of each other, and are integrally assembled by screws or an adhesive.

Figure 2:
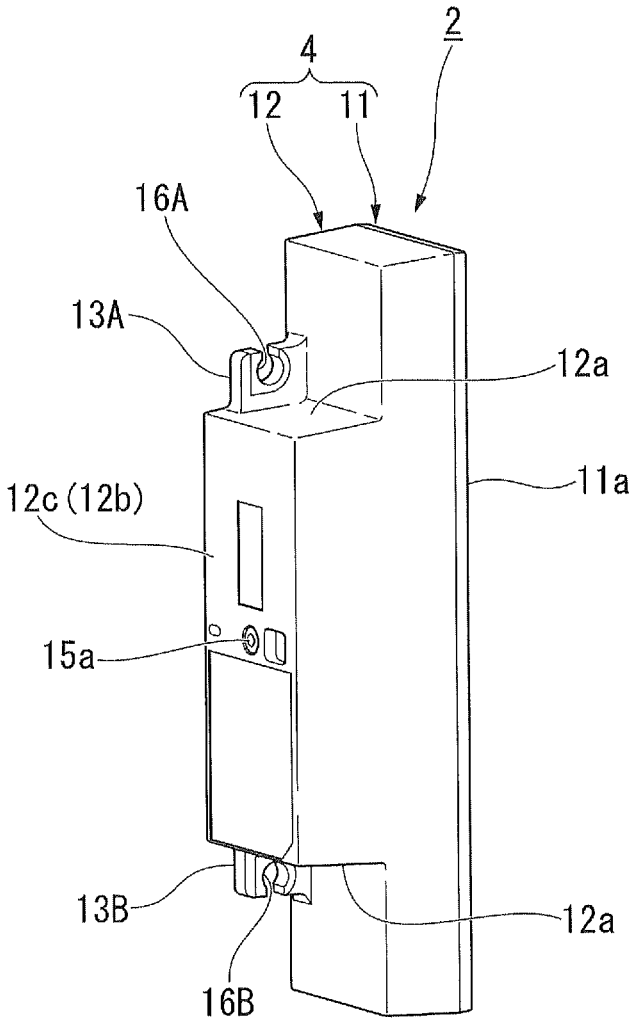
FIG. 2 is a perspective view of the speaker device shown in FIG. 1.

Referring also to FIG. 2, the first housing 11 is formed in the shape of a shallow tray whose bottom functions as the sound outputting part 11*a*, and the second housing 12 is formed in the shape of a box having a greater depth than the first housing 11. A vertical middle side of a rear portion of the second housing 12 is formed with a cuboidal rear protruding part 12*b* that forms approximately horizontal upper and lower stepped walls 12*a* and protrudes rearward. Then, upper and lower corners of a base end side of the rear protruding part 12*b* are integrally formed with upper and lower attached parts 13A and 13B, which are attached to speaker attaching parts 5 (see FIG. 8) installed on the left and right lateral portions of the monitor 1, respectively.

The rears of the left and right lateral portions of the monitor 1 become rear slant parts 6 inclined so as to be located on surface side as much as left and right outsides. Then, upper and lower middle sides of the rear slant parts 6 become the speaker attaching parts 5. The housing 4 of the speaker device 2 is provided with a monitor-side flat part 7 facing the rear slant part 6.

Figure 8:
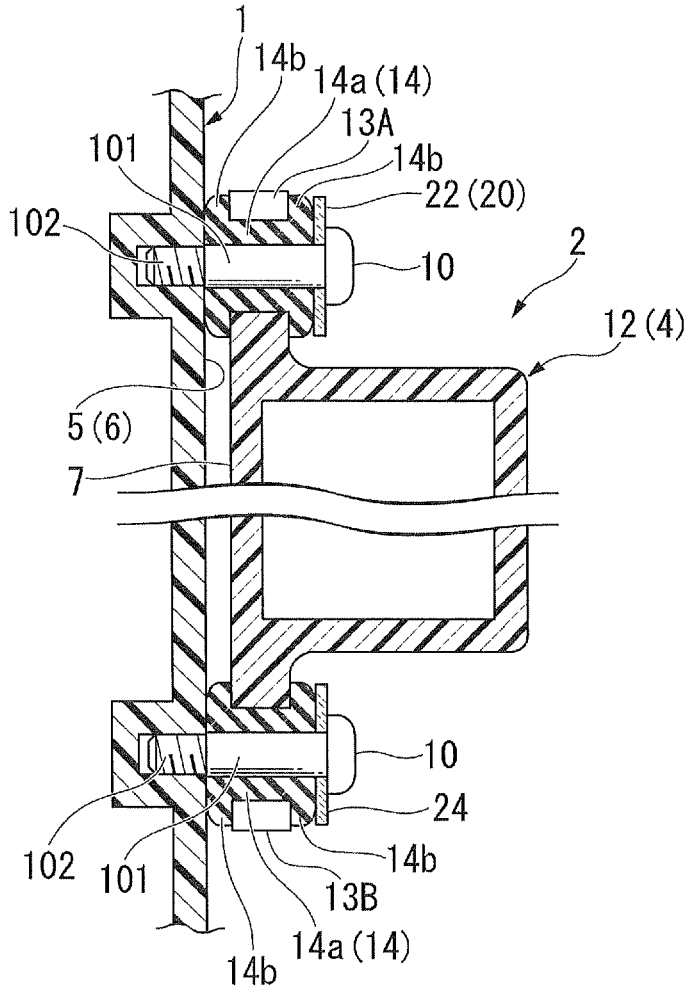
FIG. 8 is a cross-sectional view taken along line B-B of FIG. 6.

As shown in FIGS. 2 and 8, the upper and lower attached parts 13A and 13B have the shape of a thick plate facing the flat speaker attaching part 5, and are provided to the housing 4 with leaning toward the monitor 1. The portions of the upper and lower attached parts 13A and 13B which are located on the side of the monitor 1 are provided flush with the monitor-side flat part 7 of the housing 4.

Central portions of the upper and lower attached parts 13A and 13B are formed with upper and lower insertion holes 16A and 16B through which a pipe part 14*a* of a grommet 14 and a shank part 101 of a screw 10. The upper attached part 13A is configured to open the upper insertion holes 16A in an upward direction by cutting off an upper end thereof, and the lower attached part 13B is configured to open the lower insertion holes 16B in a downward direction by cutting off a lower end thereof.

Figure 5:
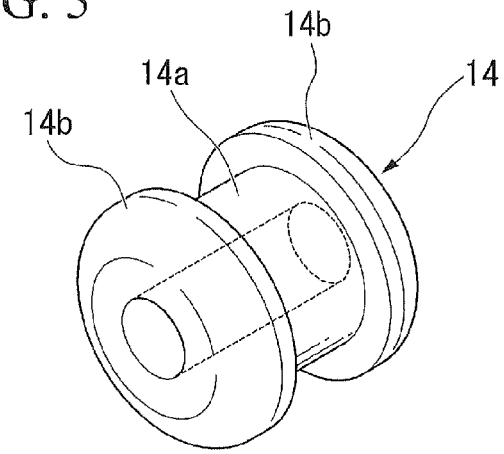
FIG. 5 is a perspective view of a grommet fitted into an attached part of the speaker device.

Referring also to FIG. 5, the grommet 14 is a rubber molding, and also functions as a sound-absorbing material (cushion) for preventing vibration of the speaker from being transmitted to the monitor 1 when the speaker device 2 is fixed to the monitor 1. The grommet 14 has a cylindrical pipe part 14*a* and flange parts 14*b* formed at opposite ends thereof in one body. The grommet 14 is fitted into each of the upper and lower attached parts 13A and 13B in such a way that the pipe part 14*a* is inserted through each of the upper and lower insertion holes 16A and 16B and that the periphery of each of the upper and lower insertion holes 16A and 16B is sandwiched between the opposite flange parts 14*b*.

Referring to FIG. 8, when the speaker device 2 is attached to the monitor 1, the grommet 14 is configured to bring the flange part 14*b* of the side of the monitor 1 into contact with the speaker attaching part 5. In this case, the monitor-side flat part 7 of the speaker device 2 is separated from the speaker attaching part 5 of the monitor 1. That is, the speaker device 2 abuts the monitor 1 only via the grommet 14. In this state, the screw 10 passing through the grommet 14 and the attached part 13A or 13B is screwed and shut into the speaker attaching part 5. Thereby, the speaker device 2 is attached to the monitor 1.

Figure 3:
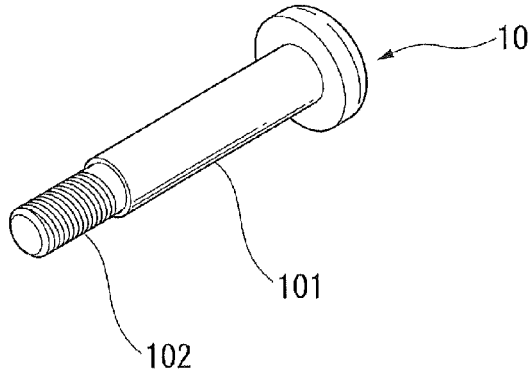
FIG. 3 is a perspective view of a screw fixing the speaker device to a monitor.

As shown in FIG. 3, the screw 10 is a shoulder bolt having the shank part 101 on a head side and a thread part 102 on a leading end side. In a state in which the shank part 101 passes through the grommet 14 and the attached part 13A or 13B, the thread part 102 is screwed to the speaker attaching part 5. In this case, the attached part 13A or 13B of the speaker device 2 and the grommet 14 are not excessively compressed.

Figure 6:
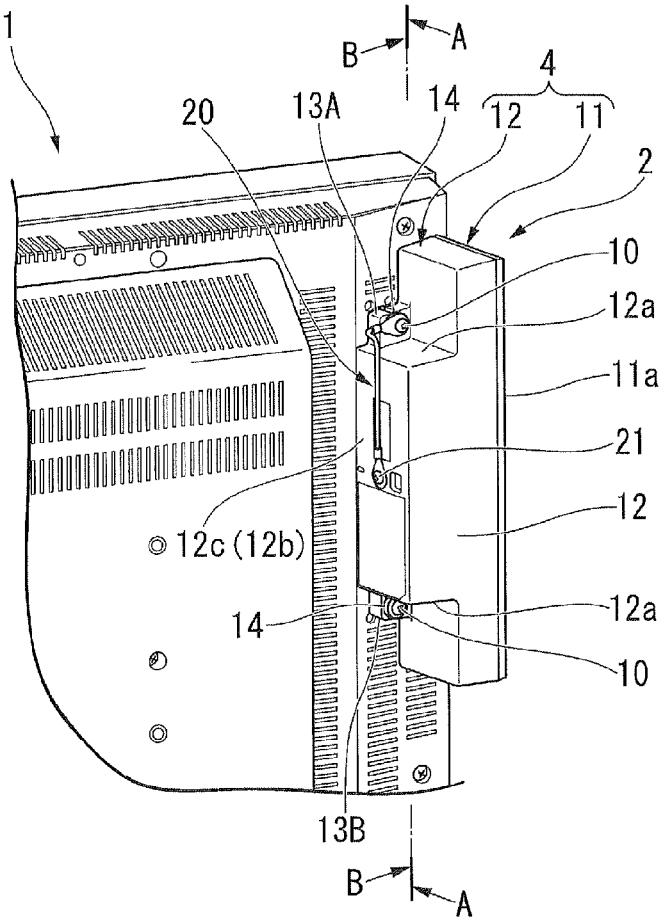
FIG. 6 is an enlarged view of a main part of FIG. 1.

Here, as shown in FIG. 6, a wire terminal 20 for preventing a fall of the speaker device 2 is bridged between a front end 12*c* of the rear protruding part 12*b* of the speaker device 2 and the upper attached part 13A.

Figure 4:
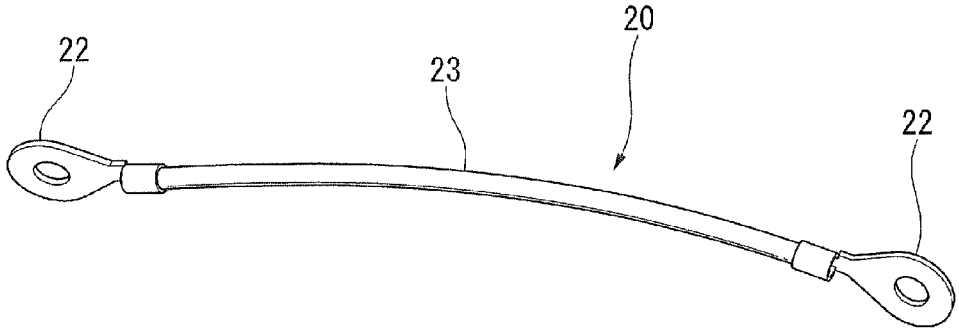
FIG. 4 is a perspective view of a fall preventing wire of the speaker device.

Referring also to FIG. 4, the wire terminal 20 is configured so that washers 22 are integrally installed on opposite ends of a steel wire 23 made by bundling up, for instance, steel wires by caulking. The configuration of the wire terminal 20 does not matter as long as it can prevent the fall of the speaker device 2.

As shown in FIG. 6, the wire terminal 20 is configured to fasten the washer 22 of the first end thereof to a vertical middle portion of the front end 12*c* of the rear protruding part 12*b* using a screw 21 and to extend upward from the washer 22 along the front end 12*c*. Afterwards, when the wire terminal 20 arrives at an upper side of the upper stepped wall 12*a* (i.e., when the wire terminal 20 has the same height as the upper attached part 13A), the wire terminal 20 is bent toward the upper attached part 13A so as to follow the upper attached part 13A, and causes the washer 22 of the second end thereof to arrive at a rear end of the grommet 14 fitted into the upper attached part 13A.

Afterwards, the shank part 101 of the screw 10 passes through the washer 22 of the second end of the wire terminal 20 and the grommet 14 fitted into the upper attached part 13A, and the thread part 102 of the screw 10 is screwed and shut into the speaker attaching part 5. Thereby, the washer 22 of the second end of the wire terminal 20 is fastened and fixed to the speaker attaching part 5 along with the upper attached part 13A. A numeral 24 of the figure indicates a washer disposed between the grommet 14 fitted into the upper attached part 13A and the head part of the screw 10 inserted through the grommet 14.

As shown in FIG. 7, a stud 15 having a threaded hole 15*a* is fixedly installed on a rear end of the speaker unit 3 of the housing 4 of the speaker device 2. The stud 15 is integrally formed with a plate 31. The plate 31 is fixed inside the rear protruding part 12*b* of the second housing 12 by a screw 32. The threaded hole 15*a* of the stud 15 is exposed to an outside of the front end 12*c* of the rear protruding part 12*b*. The washer 22 of a first end of the wire terminal 20 is fixed to the threaded hole 15*a* by the screw 10. That is, the wire terminal 20 is directly fastened to the housing 4 as well as the speaker unit 3.

Due to this configuration, even if the upper and lower attached parts 13A and 13B integrally formed with the plastic housing 4 are damaged to cause the speaker device 2 to fall from the monitor 1, the speaker device 2 does not fall from the monitor 1 in excess of a length of the wire terminal 20, because the opposite ends of the wire terminal 20 are fixed to the monitor 1 and the speaker device 2.

Further, the threaded hole (wire attaching part) 15*a* is located almost in the center (the vertical middle portion of the front end 12*c*) in a vertical direction of the speaker device 2, and is almost identical to the center of gravity of the speaker device 2. Accordingly, even when the speaker device 2 falls from the monitor 1, a weak force is applied to the housing 4 via the wire terminal 20. As such, a possibility of the wire terminal 20 falling from the housing 4 is low.

As described above, the speaker fall prevention structure of the present embodiment is a structure for preventing a fall of the speaker device 2 formed by housing the speaker unit 3 in the housing 4 independent of the monitor 1, and includes the speaker attaching part 5 provided to the monitor 1 to allow the speaker device 2 to be attached, the attached part 13A or 13B facing the speaker attaching part 5 in the speaker device 2, the fall preventing wire terminal 20 set between the speaker device 2 and the monitor 1, and a screw 10 for attaching the attached part 13A or 13B to the speaker attaching part 5. Using the screw 10, a first end of the wire terminal 20 can be fastened and fixed to the monitor 1 along with at least one of the attached parts 13A and 13B.

With this configuration, even when the attached part 13A or 13B of the speaker device 2 is broken, the fall of the speaker device 2 can be prevented by the wire terminal 20. Further, the first end of the wire terminal 20 is fastened and fixed to the monitor 1 along with the upper attached part 13A, and thereby an increase in man-hours required to attach/detach the speaker device 2 by setting the wire terminal 20 can be suppressed.

Further, the speaker fall prevention structure is configured so that the threaded hole 15*a* of the speaker device 2 to which the second end of the wire terminal 20 is attached is formed in the vertical middle portion of the speaker device 2.

With this configuration, the threaded hole 15*a* are almost identical to the center of gravity of the speaker device 2. Thereby, even when the speaker device 2 falls from the monitor 1, a weak force can be applied to the speaker device 2 and the housing 4.

Further, the speaker fall prevention structure is configured so that the housing 4 of the speaker device 2 is dividedly made up of the first housing 11 forming the sound outputting part 11*a* and the second housing 12 connected to the rear of the first housing 11, so that at least one of the first and second housings 11 and 12 is formed of a plastic molding, and so that the attached parts 13A and 13B are integrally formed with the housing. With this configuration, the housing 4 of the speaker device 2 can be easily formed, and the attached parts 13A and 13B can be integrally formed on the plastic housing, so that the structure of the housing can be simplified.

With this configuration, the housing 4 of the speaker device 2 can be easily formed, and the attached parts 13A and 13B can be integrally formed on the plastic housing, so that the structure of the housing can be simplified.

In addition, the speaker fall prevention structure is configured so that a first end of the wire terminal 20 which is fastened and fixed to the monitor 1 extends to follow an outer surface of the housing 4 of the speaker device 2, and then the second end thereof is fixed to the speaker unit 3 of the speaker device 2.

With this configuration, the length of the wire terminal 20 can be reduced to restrict an amount of fall of the speaker device 2, and the speaker unit 3 having a relatively heavy weight can be directly suspended by the wire terminal 20.

INDUSTRIAL APPLICABILITY

According to the present invention, even when the attached part of the speaker device is broken, the fall of the speaker device can be effectively prevented. An increase in man-hours and structural complication caused by setting the fall preventing wire can also be suppressed.

DESCRIPTION OF REFERENCE NUMERALS

1: MONITOR (MAIN APPLIANCE)
2: SPEAKER DEVICE
3: SPEAKER UNIT
4: HOUSING
5: SPEAKER ATTACHING PART
10: SCREW (FASTENING MEMBER)
11: FIRST HOUSING
11*a*: SOUND OUTPUTTING PART
12: SECOND HOUSING
13A: ATTACHED PART
13B: ATTACHED PART
15*a*: THREADED HOLE (WIRE ATTACHING PART)
20: WIRE TERMINAL (FALL PREVENTING WIRE)

The invention claimed is:

1. A speaker fall prevention structure for preventing a fall of a speaker device formed by housing a speaker unit in a housing independent of a main appliance, comprising:

a speaker attaching part provided on the main appliance to allow the speaker device to be attached;

an attached part facing the speaker attaching part in the speaker device;

a fall preventing wire set between the speaker device and the main appliance; and a fastening member for attaching the attached part to the speaker attaching part, wherein, using the fastening member, a first end of the fall preventing wire is fastened and fixed to the main appliance along with the attached part, and a second end of the fall preventing wire is located at a position almost identical to the center of gravity of the speaker device and is fixed to the speaker device.

2. The speaker fall prevention structure according to claim 1, wherein a wire attaching part of the speaker device to which the second end of the fall preventing wire is attached is formed on a vertical middle portion of the speaker device.

3. The speaker fall prevention structure according to claim 2, wherein the housing of the speaker device is dividedly made up of a first housing forming a sound outputting part and a second housing connected to a rear of the first housing, at least one of the first and second housings is formed of a plastic molding, and the attached part is integrally formed with the housing.

4. The speaker fall prevention structure according to claim 2, wherein the fall preventing wire is configured so that the first end thereof which is fastened and fixed to the main appliance extends to follow an outer surface of the housing of the speaker device, and the second end thereof is fixed to the speaker unit of the speaker device.

5. The speaker fall prevention structure according to claim 1, wherein the housing of the speaker device is dividedly made up of a first housing forming a sound outputting part and a second housing connected to a rear of the first housing, at least one of the first and second housings comprises a plastic molding, and the attached part is integrally formed with the housing.

6. The speaker fall prevention structure according to claim 5, wherein the fall preventing wire is configured so that the first end thereof which is fastened and fixed to the main appliance extends to follow an outer surface of the housing of the speaker device, and the second end thereof is fixed to the speaker unit of the speaker device.

7. The speaker fall prevention structure according to claim 1, wherein the fall preventing wire is configured so that the first end thereof which is fastened and fixed to the main appliance extends to follow an outer surface of the housing of the speaker device, and the second end thereof is fixed to the speaker unit of the speaker device.

8. The speaker fall prevention structure according to claim 1, wherein the second end of the fall preventing wire is fixed at a center of a rear end of the speaker unit.

9. A speaker fall prevention structure for preventing a fall of a speaker device formed by housing a speaker unit in a housing independent of a main appliance, comprising:

a speaker attaching part provided on the main appliance to allow the speaker device to be attached;

an attached part facing the speaker attaching part in the speaker device, the attached part including an upper attached part and a lower attached part;

a fall preventing wire set between the speaker device and the main appliance; and a fastening member for attaching the attached part to the speaker attaching part, wherein, using the fastening member, the speaker device is fixed to the main appliance at the upper attached part and the lower attached part of the attached part, and the fall preventing wire is fixed to the upper attached part and is fixed to the main appliance.

10. The speaker fall prevention structure according to claim 9, wherein a wire attaching part of the speaker device to which a second end of the fall preventing wire is attached is formed on a vertical middle portion of the speaker device.

11. The speaker fall prevention structure according to claim 10, wherein the housing of the speaker device is dividedly made up of a first housing forming a sound outputting part and a second housing connected to a rear of the first housing, at least one of the first and second housings comprises a plastic molding, and the attached part is integrally formed with the housing.

12. The speaker fall prevention structure according to claim 10, wherein the fall preventing wire is configured so that a first end thereof which is fastened and fixed to the main appliance extends to follow an outer surface of the housing of the speaker device, and the second end thereof is fixed to the speaker unit of the speaker device.

13. The speaker fall prevention structure according to claim 9, wherein the housing of the speaker device is dividedly made up of a first housing forming a sound outputting part and a second housing connected to a rear of the first housing, at least one of the first and second housings comprises a plastic molding, and the attached part is integrally formed with the housing.

14. The speaker fall prevention structure according to claim 13, wherein the fall preventing wire is configured so that a first end thereof which is fastened and fixed to the main appliance extends to follow an outer surface of the housing of the speaker device, and a second end thereof is fixed to the speaker unit of the speaker device.

15. The speaker fall prevention structure according to claim 9, wherein the fall preventing wire is configured so that a first end thereof which is fastened and fixed to the main appliance extends to follow an outer surface of the housing of the speaker device, and a second end thereof is fixed to the speaker unit of the speaker device.

16. The speaker fall prevention structure according to claim 9, wherein a second end of the fall preventing wire is fixed at a center of a rear end of the speaker unit.

17. A structure comprising:

a speaker device comprising:

a housing comprising a rear protruding part including a hole; and a speaker unit formed in the housing and including a stud fixed to a rear end of the speaker unit, a threaded hole in the stud being aligned with the hole in the rear protruding part and being formed at substantially a center of gravity of the speaker device;

an attaching member formed on the rear protruding part and including a hole for accommodating a first fastening member for fastening the speaker device to an appliance; and a wire comprising:

a first end including a first washer for connecting the wire to the attaching member, the first washer including a hole for accommodating the first fastening member; and a second end including a second washer for connecting the wire to the rear protruding part of the housing, the second washer including a hole which is aligned with the threaded hole in the stud and the hole in the rear protruding part, for accommodating a second fastening member for fastening the second washer to the stud.

* * * * *